US005769432A

United States Patent [19]

Tybinkowski et al.

[11] Patent Number: 5,769,432

[45] Date of Patent: Jun. 23, 1998

[54] LOCK ASSEMBLY FOR IN-LINE SKATE

[76] Inventors: Andrew P. Tybinkowski; Peter A. Tybinkowski, both of 39 Burning Bush Dr., Boxford, Mass. 01921; Roderick D. Swift, 76 Tobey Rd., Belmont, Mass. 02178

[21] Appl. No.: 571,761

[22] Filed: Dec. 13, 1995

[51] Int. Cl.[6] ..... A63C 17/14

[52] U.S. Cl. ..... 280/11.2; 280/11.22; 301/5.7

[58] Field of Search ..... 301/5.3, 6.1, 5.7; 280/11.2, 11.21, 11.22, 11.23, 825; 188/1.12, 31, 69, 265

[56] References Cited

U.S. PATENT DOCUMENTS

| | | | |
|---|---|---|---|
| 4,295,547 | 10/1981 | Dungan | 188/2 R |
| 4,488,761 | 12/1984 | Buell | 301/6 E |
| 4,550,808 | 11/1985 | Folson | 188/1.12 |
| 4,669,580 | 6/1987 | Neville | 188/1.12 |
| 5,002,163 | 3/1991 | Kidd | 188/83 |
| 5,028,058 | 7/1991 | Olson | 280/11.22 |
| 5,207,438 | 5/1993 | Landers | 280/11.2 |
| 5,226,673 | 7/1993 | Cech | 280/11.2 |
| 5,257,795 | 11/1993 | Babcock | 280/11.2 |
| 5,271,633 | 12/1993 | Hill, Jr. | 280/11.22 |
| 5,275,259 | 1/1994 | Roberts | 188/5 |
| 5,312,165 | 5/1994 | Spletter | 301/5.23 |
| 5,335,924 | 8/1994 | Richards, Sr. | 280/11.2 |
| 5,351,974 | 10/1994 | Cech | 280/11.2 |
| 5,356,209 | 10/1994 | Hill | 301/5.7 |
| 5,368,133 | 11/1994 | Yang | 188/1.12 |
| 5,379,866 | 1/1995 | Pearce et al. | 188/2 F |
| 5,421,434 | 6/1995 | Liao | 188/1.12 |

FOREIGN PATENT DOCUMENTS

WO9419073 9/1994 WIPO .

*Primary Examiner*—David M. Mitchell
*Attorney, Agent, or Firm*—Pandiscio & Pandiscio

[57] ABSTRACT

A wheel lock assembly for an in-line skate includes an axle assembly for supporting a skate wheel and defining an enclosed cavity, and an actuator assembly comprising an actuator member disposed in the cavity movable by a control member disposed externally of the axle assembly. The lock assembly further includes a lock pad assembly comprising a lock pad adapted to engage an inside surface of the skate wheel mounted on the axle assembly, a support beam extending from the pad inwardly through a portion of the axle assembly and into the cavity, and a spring urging the lock pad and support inwardly to bias a free end of the support against the actuator member. Manipulation of the control member causes movement of the actuator member in the cavity, to cause movement of the support, to cause radial movement of the lock pad selectively into and out of engagement with the skate wheel inside surface.

26 Claims, 20 Drawing Sheets

SECTION I–I

SECTION II–II

SECTION IV–IV

LOCK ASSEMBLY FOR IN-LINE SKATE

FIELD OF THE INVENTION

The present invention relates generally to wheel lock systems, and more particularly to a lock assembly for locking the wheels of an in-line skate in a non-rotative mode.

BACKGROUND OF THE INVENTION

In-line skates are provided with a plurality of wheels, or rollers, each rotating on its own axle, parallel to the other wheel axles, and secured to a common frame on the sole of a skate boot or shoe. The wheels of each skate are deployed in line, so as to carry the weight of the skater while allowing the skater to roll the skates independently forwardly or rearwardly in skating maneuvers similar to those employed by ice-skaters.

It is desirable that such skates be provided with means for locking the wheels in a non-rotative state, so that the skater may walk on surfaces, stairways, inclines, and the like, which may be unsafe or inappropriate for skating.

Brake assemblies for in-line skates are generally known in the art. In International Application No. PCT/US94/01727, published Sep. 1, 1994, there is set forth a brief review of known types of brakes, including heel brakes, which are devices attached to the rear portion of the skate frame and brought into play by a skater positioning a foot such that a brake pad of the heel brake drags on the skating surface. Another known type of brake is a toe brake. Such brakes typically include a friction pad located at a forward portion of the frame which, in operation, is brought to bear on the skating surface by a foot maneuver by the skater. In another type of braking system, an instep portion of the boot or shoe is provided with a braking pad. Braking is effected by placing that boot behind the other and perpendicular to the direction of forward motion while dragging the braking boot and pressing down on the instep braking surface. Alternatively, the boot may be placed forward of the other and placed sideways so as to engage the instep braking surface with the skating surface. All such systems are designed for slowing or stopping travel and not for locking the wheels in place in a non-rotative condition until released. Accordingly, such braking systems are of no use to the skater who desires to lock the wheels in place so that walking on the skates can be undertaken safely. For examples of some of the above types of brake systems, see U.S. Pat. Nos. 5,207,438 (toe brake); 5,257,795 (heel brake); 5,275,259 (heel brake); and 5,335,924 (heel brake).

In U.S. Pat. No. 5,312,165, issued May 17, 1994, there are described several brake systems for in-line skates wherein there are utilized hand-operated brakes. Again, such brakes are designed for use in slowing and stopping and are not suitable for locking wheels in place. Hand-operated brake systems are also disclosed in U.S. Pat. Nos. 5,226,673 and 5,351,974.

There is a need for a lock assembly by which an operator quickly and easily can lock the wheels of a skate in a stationary mode, and just as easily unlock the wheels for usual skating movements.

In FIGS. 1–7, there is shown an illustrative prior art in-line skate wheel assembly which includes side frames 2, 4 depending from a boot or shoe sole 6. A wheel 8 is mounted upon ball bearings 10 disposed around an axle member 12. The axle member 12 is supported and retained by a bolt member 14 extending through the axle 12 and retained by a locking nut 16. The bolt member 14 is disposed in journal bearings 18 which, in turn, are disposed in openings 20 in the side frames 2, 4. In operation, the axle member 12 and bolt 14 remain stationary and the wheel 8 turns on the ball bearings 10. Between the axle member 12 and an internal wheel surface 22, there is formed a cavity 24, which is unoccupied.

OBJECTS OF THE INVENTION

Accordingly, one object of the invention is to provide an in-line skate lock assembly which is operative to lock the wheels of a skate in a non-rotative mode.

A further object of the invention is to provide such an assembly which is easily retrofitted into existing skates, as illustrated in FIG. 1, without alteration of the frame, wheels, and bearings of the existing skates, and without the need of special tools.

A further object of the invention is to provide such an assembly which, when retrofitted into existing skates, does not alter the configuration, appearance, or operating characteristics of the skate.

A still further object of the invention is to provide such an assembly which is mounted on the skate and requires no separately-carried locking activator or other device.

A still further object of the invention is to provide such an assembly which, in a skating mode, is stored out of the way and does not extend beyond the periphery of the skate boot or shoe.

Still another object of the invention is to provide such an assembly which comprises only mechanical parts and is inexpensive to manufacture and economical to obtain and use.

SUMMARY OF THE INVENTION

These and other objects of the present invention are achieved by the provision and use of a novel wheel lock assembly for an in-line skate. The novel lock assembly comprises an axle assembly for supporting a skate wheel and defining an enclosed cavity, and an actuator assembly comprising an actuator member disposed in the cavity and movable by a control member disposed externally of the axle assembly. The lock assembly further comprises a lock pad assembly comprising lock pad means adapted to engage an inside surface of the skate wheel mounted on the axle assembly, support beam means extending from the pad means inwardly through a portion of the axle assembly and into the cavity, and a spring urging the lock pad means and support beam means inwardly to bias free ends of the support beam means against the actuator member. Manipulation of the control member causes movement of the actuator member in the cavity, to cause radially outward movement of the support beam means, to cause movement of the lock pad means selectively into and out of engagement with the skate wheel inside surface.

BRIEF DESCRIPTION OF THE DRAWINGS

These and other objects, features and advantages, of the present invention will be more fully disclosed in, or rendered obvious by, the following detailed description of the preferred embodiments of the invention, which are to be considered together with the accompanying drawings wherein like numbers refer to like parts and further wherein.

DETAILED DESCRIPTION OF THE PREFERRED EMBODIMENTS

Figure 8:
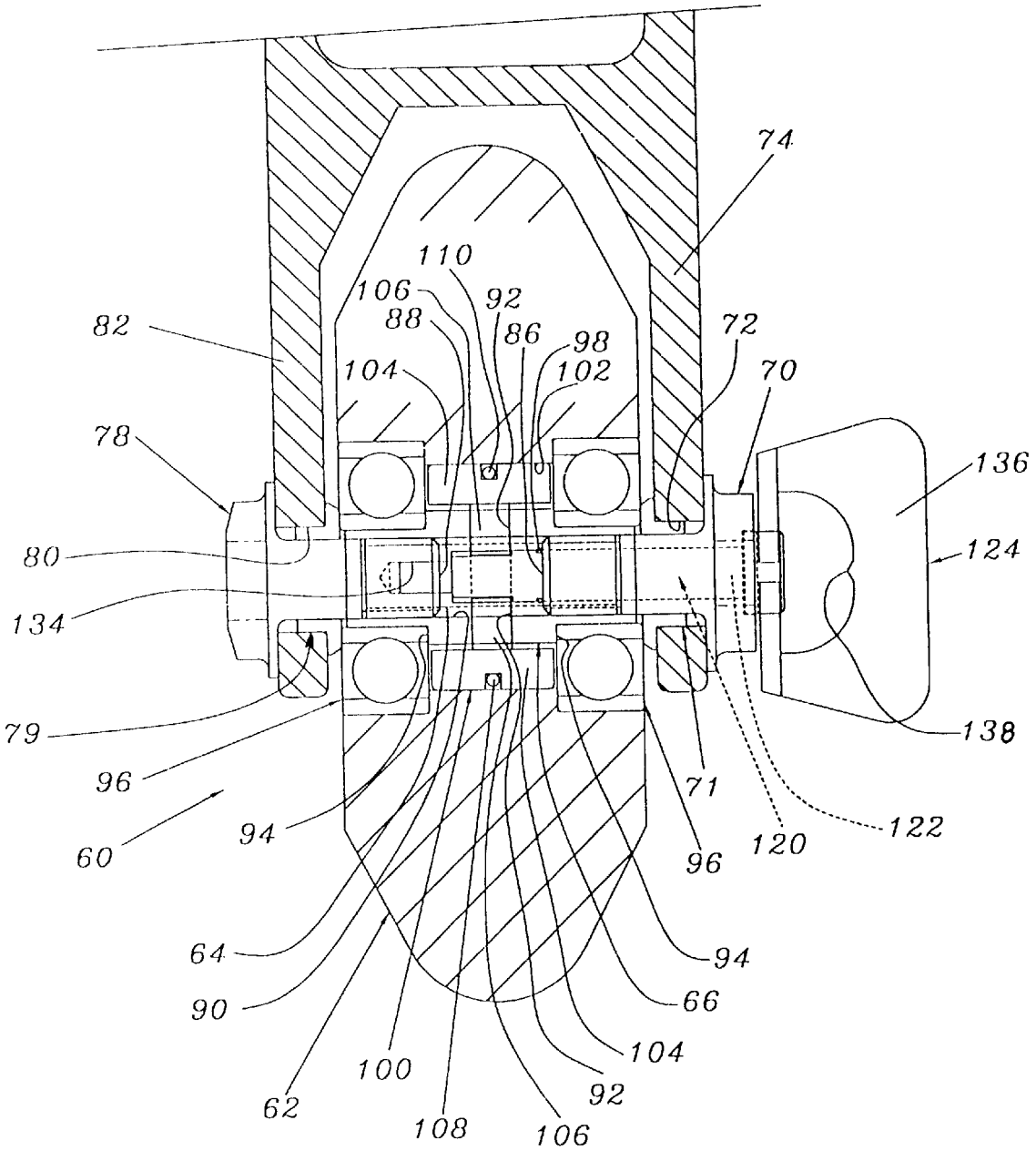
FIG. 8 is a partly sectional, partly elevational, front view of one form of wheel lock assembly illustrative of an embodiment of the invention.
Figure 16:
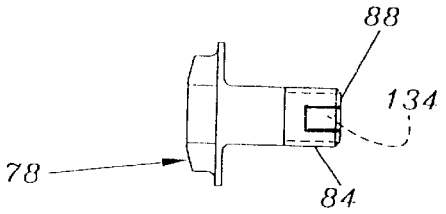
FIG. 16 is a front elevational view of the bolt component of FIG. 15.
Figure 17:
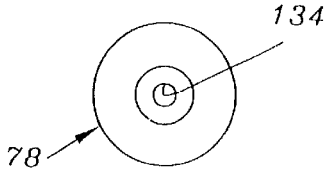
FIG. 17 is a side elevational view opposite from that shown in FIG. 15.
Figure 18:
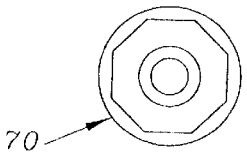
FIG. 18 is a side elevational view of another bolt component of the axle assembly portion of the lock assembly shown in FIG. 8.
Figure 19:
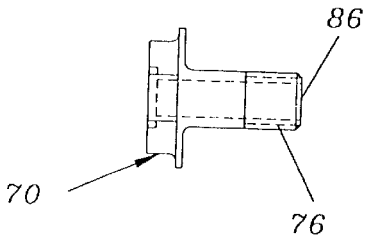
FIG. 19 is a front elevational view of the bolt component FIG. 18.
Figure 20:
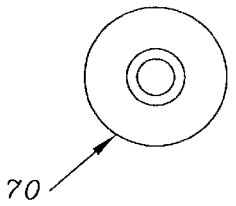
FIG. 20 is a side elevational view opposite from that shown in FIG. 18.
Figure 21:
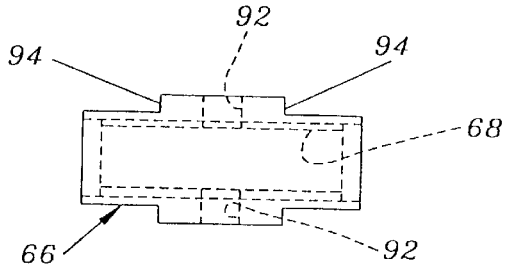
FIG. 21 is a front elevational view of an axle component of the axle assembly portion of the lock assembly shown in FIG. 8.
Figure 22:
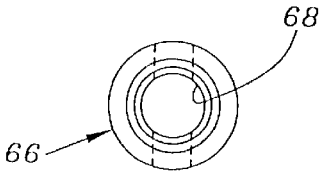
FIG. 22 is a side elevational view of the axle assembly portion of FIG. 21.
Figure 23:
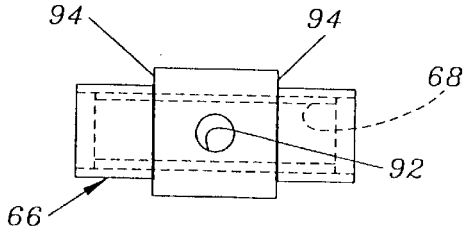
FIG. 23 is a top plan view of the axle assembly portion of FIG. 21.
Figure 25:
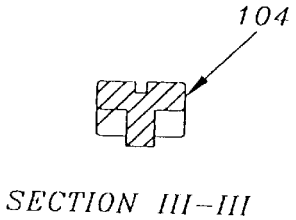
FIG. 25 is a sectional view of the lock pad assembly taken along line III—III of FIG. 24.

Referring first to FIG. 8, a wheel anti-rotation lock assembly for an in-line skate is shown which is formed in accordance with the present invention. The lock assembly comprises an axle assembly 60 which supports a wheel 62 and in which is disposed a bore, or chamber, or cavity 64. The axle assembly 60 includes a bushing or axle 66 (FIGS. 8, 21–23) having internal threads 68, a first bolt 70 (FIGS. 8, 18–20) for disposition in a first journal bearing 71 in a first opening 72 in a first side frame portion 74 and having external threads 76 (FIG. 19) for threaded engagement with the axle 66, and a second bolt 78 (FIGS. 8, 15–17) for disposition in a second journal bearing 79 in a second opening 80 in a second side frame portion 82, and having external threads 84 (FIG. 16) for threaded engagement with the axle 66. Ends 86, 88 of the first and second bolts 70, 78, respectively, are spaced from each other (FIG. 8) and comprise walls of the cavity 64. The axle 66 defines further wall portions 90 of the cavity 64. The axle 66 is provided with opposed holes 92 therein (FIGS. 8, 21–23), and is further provided with annular shoulders 94 for receiving the inner race of ball bearings 96.

Figure 9:
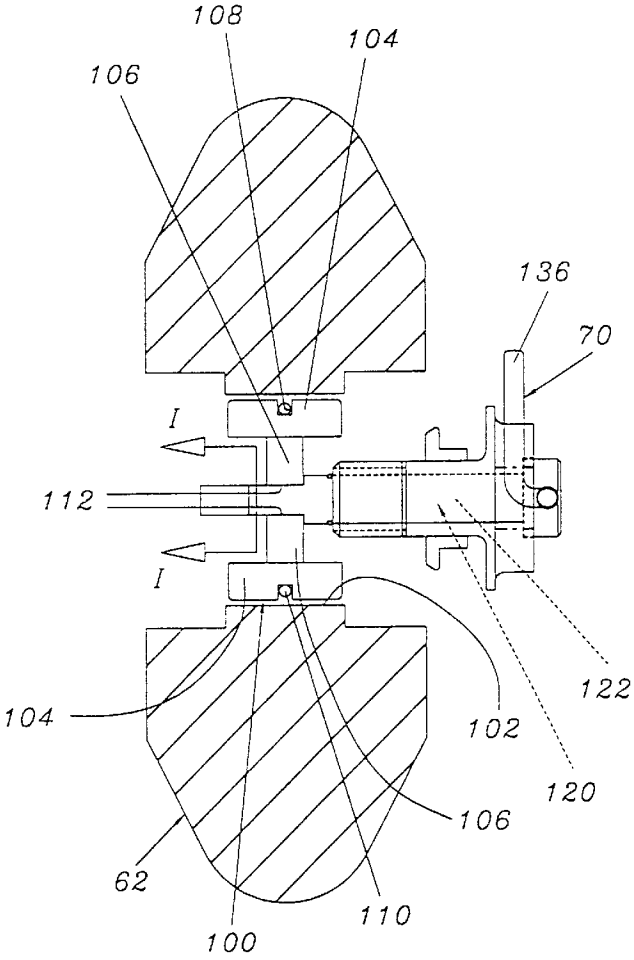
FIG. 9 is a front elevational view of the actuator assembly portion shown in FIG. 8, and of the lock assembly shown in FIG. 8, the wheel being shown in section, and the actuator assembly being shown in a disengaged position.
Figure 10:
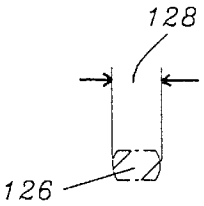
FIG. 10 is a sectional view taken along line I—I of FIG. 9.
Figure 12:
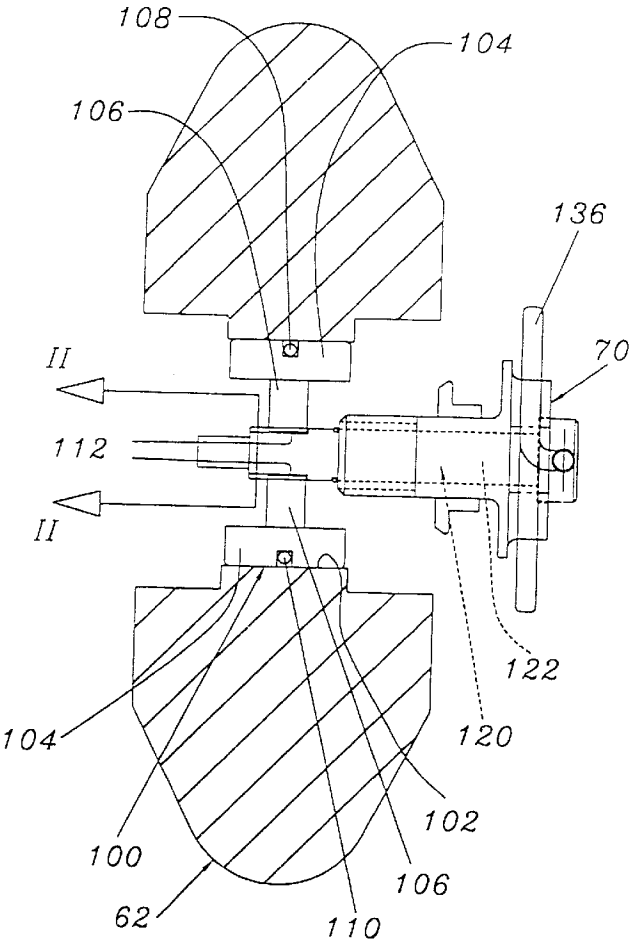
FIG. 12 is similar to FIG. 9, but shows the actuator assembly in an engaged position, having turned 90° from the position shown in FIG. 9.
Figure 13:
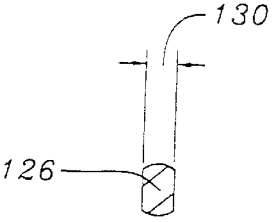
FIG. 13 is a sectional view taken along line II—II of FIG. 12.
Figure 15:
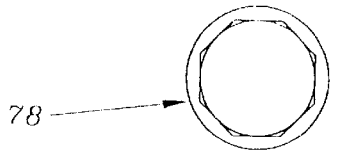
FIG. 15 is a side elevational view of a bolt component of the axle assembly portion of the lock assembly shown in FIG. 8.

The bolts 70, 78 are tightly turned in the side frame portions 74, 82 which exert an outward force on the bolts to retain the bolts in a non-movable condition, while the axle 66 is held in compression, providing stable support for the wheel 62. The axle 66 and bolts 70, 78 remain stationary and the wheel 62 turns therearound on the ball bearings 96. A lock pad assembly 100 (FIGS. 8, 9, and 12) is disposed within the wheel 62 for engaging an internal surface 102 of the wheel 62 to lock the wheel against rotative movement. The lock pad assembly 100 includes at least two pad means 104, which are engageable with the wheel surface 102, support beam means 106 extending from the pad means 104 through the holes 92 in the axle 66 and into the cavity 64, and spring means 108 disposed in a groove 110 for urging free ends 112 (FIGS. 9, 12) of the lock assembly support beam means 106 radially inwardly of the cavity 64.

Figure 1:
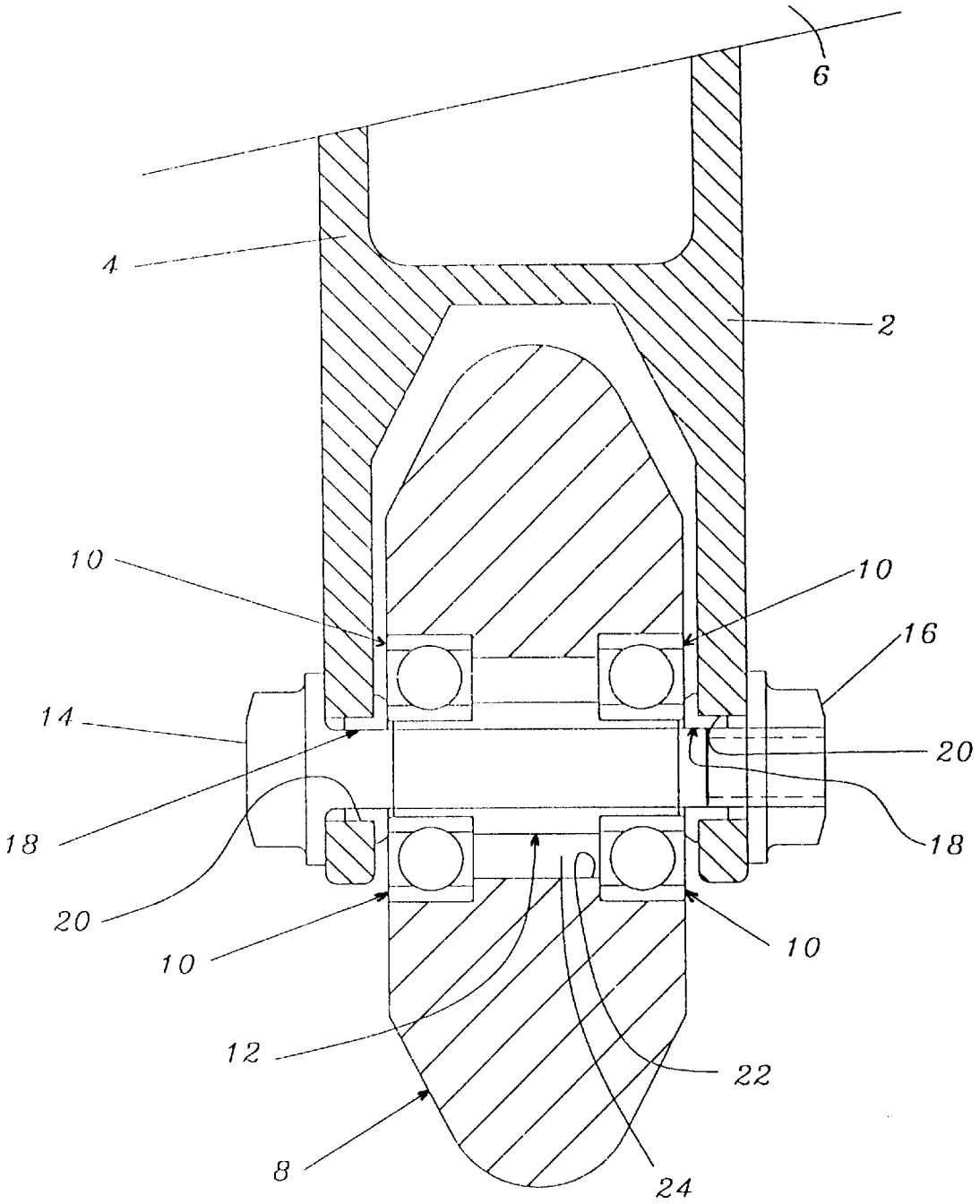
FIG. 1 PRIOR ART
FIG. 1 is a partly sectional, partly elevational front view of a prior art wheel assembly.
Figure 2:
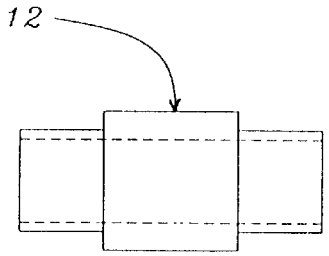
FIG. 2 PRIOR ART
FIG. 2 is a front elevational view of an axle member of the assembly of FIG. 1.
Figure 3:
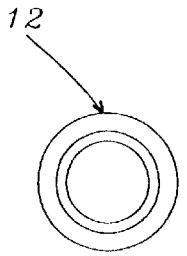
FIG. 3 PRIOR ART
FIG. 3 is an end elevational view of the axle member of FIG. 2.
Figure 5:
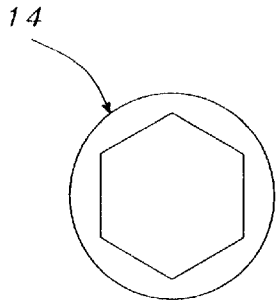
FIG. 5 PRIOR ART
FIG. 5 is an end elevational view of the bolt member of FIG. 4.
Figure 4:
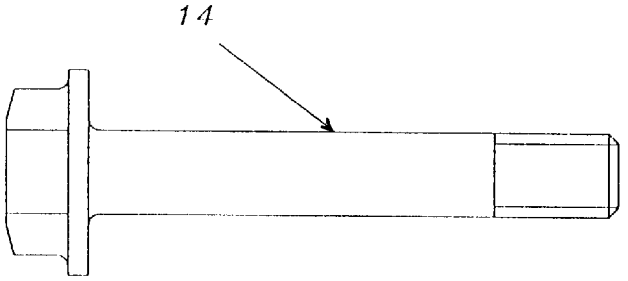
FIG. 4 PRIOR ART
FIG. 4 is a front elevational view of a bolt member of the assembly of FIG. 1.
Figure 6:
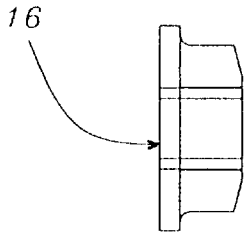
FIG. 6 PRIOR ART
FIG. 6 is a front elevational view of a locking nut member of the assembly of FIG. 1.
Figure 7:
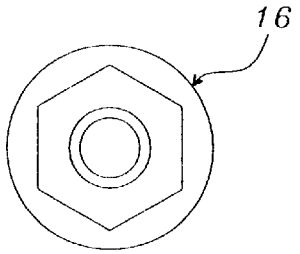
FIG. 7 PRIOR ART
FIG. 7 is an end elevational view of the locking nut member of FIG. 6.
Figure 24:
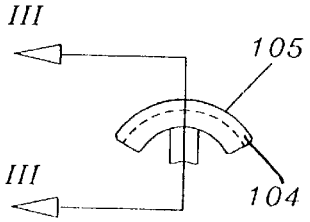
FIG. 24 is a side elevational view of the lock pad assembly of FIG. 8.
Figure 26:
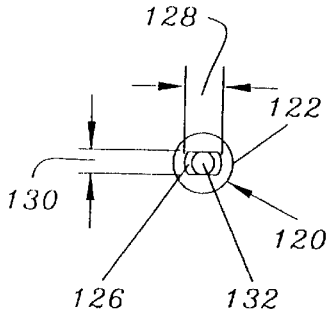
FIG. 26 is a side elevational view of the actuator member port on of the lock assembly shown in FIG. 8.
Figure 27:
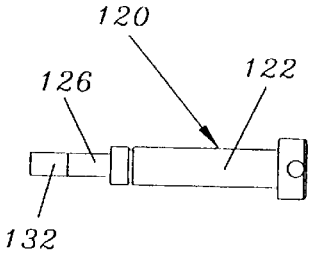
FIG. 27 is a front elevational view of the actuator member of FIG. 26.
Figure 28:
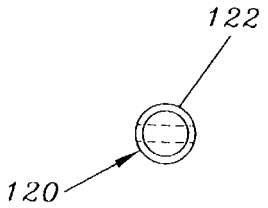
FIG. 28 is a side elevational view opposite from that shown in FIG. 26.

Referring to FIG. 24, it will be seen that the pad means 104 are each provided with a knurled surface 105 for engagement with the wheel internal surface 102. The knurled surfaces 105 provide for high-friction engagement with the roller wheels 62. The wheel internal surface 102 is a surface present in prior art skate wheels (see element 22 in FIG. 1) and need not be modified in any manner for adaptation to the locking system described herein.

The illustrative embodiment of FIG. 8 further includes an actuator assembly 120 (FIGS. 8, 26–28) comprising an actuator member 122 disposed in part in the cavity 64 and connected to, or otherwise movable by, a control member 124 (FIG. 8) disposed externally of the axle assembly 60. The actuator member 122 extends through the axle assembly 60 centrally and axially thereof. The actuator member 122 includes an actuator body portion 126 which is disposed in the cavity 64 and against which the free ends 112 of the support beam means 106 (FIGS. 9 and 12) are biased by the spring means 108.

The actuator member 122 is rotatably mounted in the axle assembly 60. The actuator body portion 126, in transverse cross section, has a larger first width 128 and a smaller second width 130 (FIG. 26), the first width 128 being substantially perpendicular to the second width 130. Thus, upon rotation of the actuator member 122, such that the actuator body portion first width 128 is deployed adjacent the support beam ends 112 (FIGS. 8, 12), the actuator body portion 126 urges the support beam means 106, and thereby the pad means 104, radially outwardly, such that the pad means surfaces 105 engage the skate wheel inside surface 102. A retaining ring 98 (FIG. 8) prevents the actuator body portion 126 from being dislodged or pulled out of the bolt 70. The actuator member 122 is provided with an end support portion 132 received in a recess 134 in the second bolt 78 (FIGS. 8, 16, 17), to support the actuator body portion 126 in the cavity 64.

Figure 11:
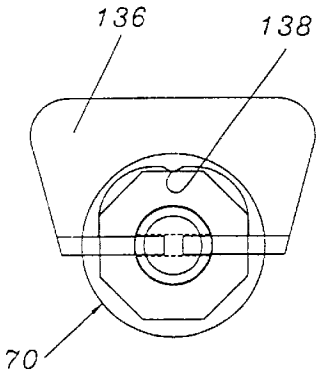
FIG. 11 is a side elevational view of the actuator assembly shown in FIG. 9.
Figure 14:
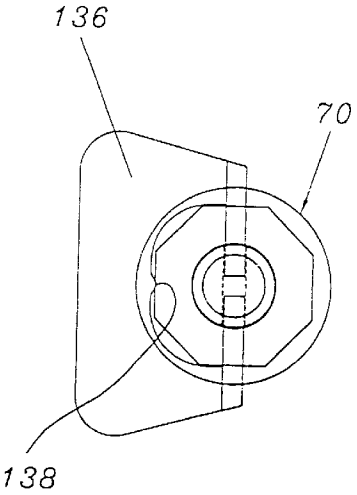
FIG. 14 is a side elevational view of the actuator assembly shown in FIG. 12.

In the embodiment shown in FIG. 8, the control member 124 comprises a latch member 136 pivotally connected to the actuator member 122 and movable among an actuating position (FIG. 8) wherein the latch member 136 extends axially of the actuator member 122 and the axle assembly 60, a second position (FIGS. 9 and 11) wherein the latch member 136 is disposed generally perpendicular to the actuator member 122 and the axle assembly 60, when the lock is not activated, and a third position (FIGS. 12 and 14) wherein the latch member 136 is disposed generally perpendicular to the actuator member 122 and the axle assembly 60 when the lock is engaged.

The latch member 136 is provided with a nib 138 (FIGS. 8, 11 and 14) which, when the latch member is in the second and third positions, frictionally engages the head of the bolt 70 for locking the latch member 136, and thereby the actuator lever assembly 120, in place.

In operation of the embodiment shown in FIG. 8, the lock pad means 104 are normally removed from the skate wheel surface 102 (FIG. 9), so that the wheels 62 of the skate are free to turn on their axles. When it is desired to lock the wheels against rotative movement, the latch member 136 is manually moved from the position shown in FIGS. 9 and 11, to the position shown in FIG. 8. Using the latch member 136 as a handle, or grip member, the actuator assembly 120 is rotated about 90° in the bolts 70, 78 to move the actuator body second width 130 from engagement with the support ends 112 and to introduce the actuator body first width 128 between the support ends 112, thereby forcing the support beam means 106 radially outwardly and the pad means 104 into firm engagement with the skate wheel internal surface 102 (FIGS. 8 and 12), to render the wheel 62 immobile. The latch member 136 is then moved to the position shown in FIGS. 12 and 14 to place the latch member 136 safely inboard of the skate. To release the wheels, the latch member 136 is moved back to the position shown in FIG. 8, turned a quarter-turn, and moved to the position shown in FIGS. 9 and 11, whereupon the spring means 108 urges the pad means 104 inwardly, to return the pad means 104 to a non-locking position. It will be appreciated that the spring 108 continually biases the pad means toward a disengaged, non-locking position.

Figure 29:
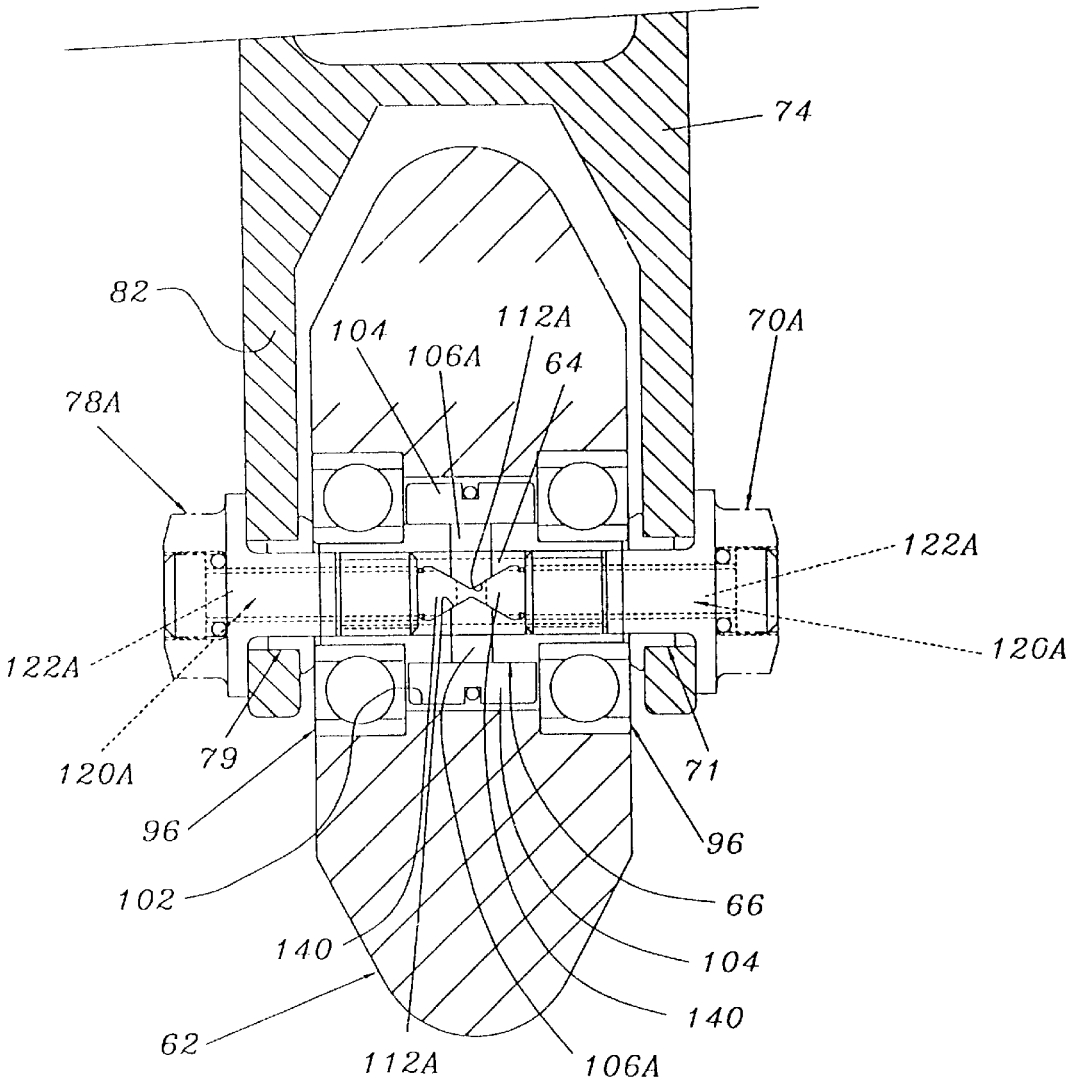
FIG. 29 is a partly sectional, partly elevational, front view of another form of wheel anti-rotation lock assembly shown in a disengaged position, and illustrative of an alternative embodiment of the invention.
Figure 33:
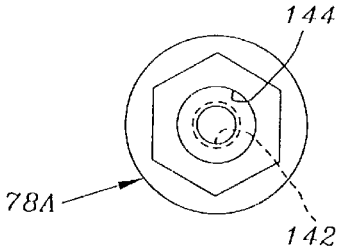
FIG. 33 is a side elevational view of a bolt component of the lock assembly shown in FIG. 29.
Figure 34:
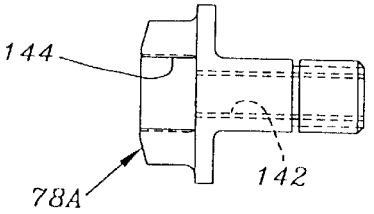
FIG. 34 is a front elevational view of the bolt of FIG. 33.
Figure 35:
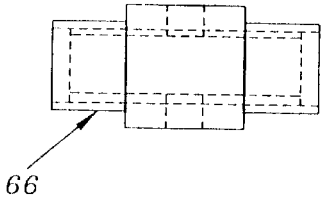
FIG. 35 is a front elevational view of an axle component of the lock assembly shown in FIG. 29.
Figure 36:
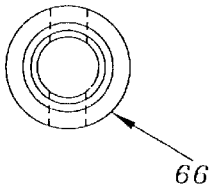
FIG. 36 is a side elevational view of the axle of FIG. 35.
Figure 37:
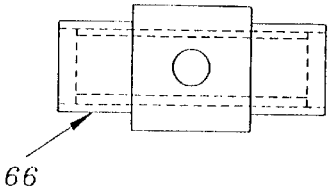
FIG. 37 is a top plan view of the axle of FIG. 35.
Figure 38:
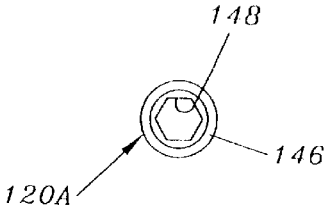
FIG. 38 is a side elevational view of an actuator member portion of the lock assembly of FIG. 29.
Figure 39:
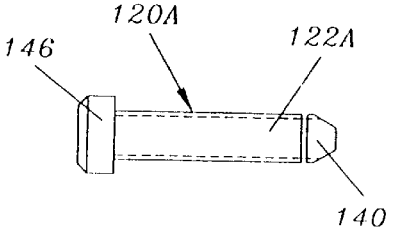
FIG. 39 is a front elevational view of the actuator member of FIG. 38.

In FIG. 29, there is shown an alternative embodiment featuring an actuator assembly 120A different from the actuator assembly 120 shown in FIG. 8. Referring to FIG. 29, it will be seen that the actuator assembly 120A includes two opposed actuator members 122A which are threaded (FIG. 39) and provided with generally frusto-conically shaped ends 140. The bolts 70A, 78A are identical to each other (bolt 78A is shown in FIGS. 33 and 34) and have internal threads 142 for threadably receiving the threaded actuator member 122A (FIGS. 38 and 39). The bolts 70A, 78A are provided with recesses 144 (FIGS. 33 and 34) for receiving head portions 146 (FIGS. 38 and 39) of the threaded actuator members 122A. The actuator members 122A are provided with hexagonal, or similar, recesses 148 (FIG. 38) for receiving a wrench (not shown) by which the actuator members 122A may be turned.

Figure 31:
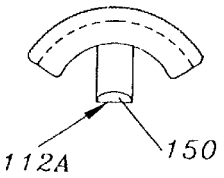
FIG. 31 is a side elevational view of the lock pad assembly portion of the lock assembly of FIG. 29.
Figure 32:
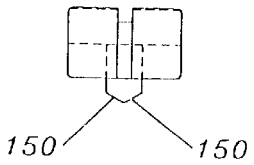
FIG. 32 is a front elevational view of the lock pad assembly of FIG. 31.

In the embodiment shown in FIG. 29, the free ends 112A of the lock assembly support beam means 106A are shaped complementary to the frusto-conical configuration of the actuator member ends 140 (FIG. 39). In the embodiment shown, the support free ends 112A are provided with two inclined surfaces 150 (FIGS. 31 and 32) per support beam, such that one support beam may interact with two of the threaded actuator members 122A, as shown in FIG. 29. It will be apparent that the actuator assembly 120A may well include only one threaded actuator member 122A, rather than the two illustrated, in which case the support free ends 112A need be provided with only a single inclined surface.

Figure 30:
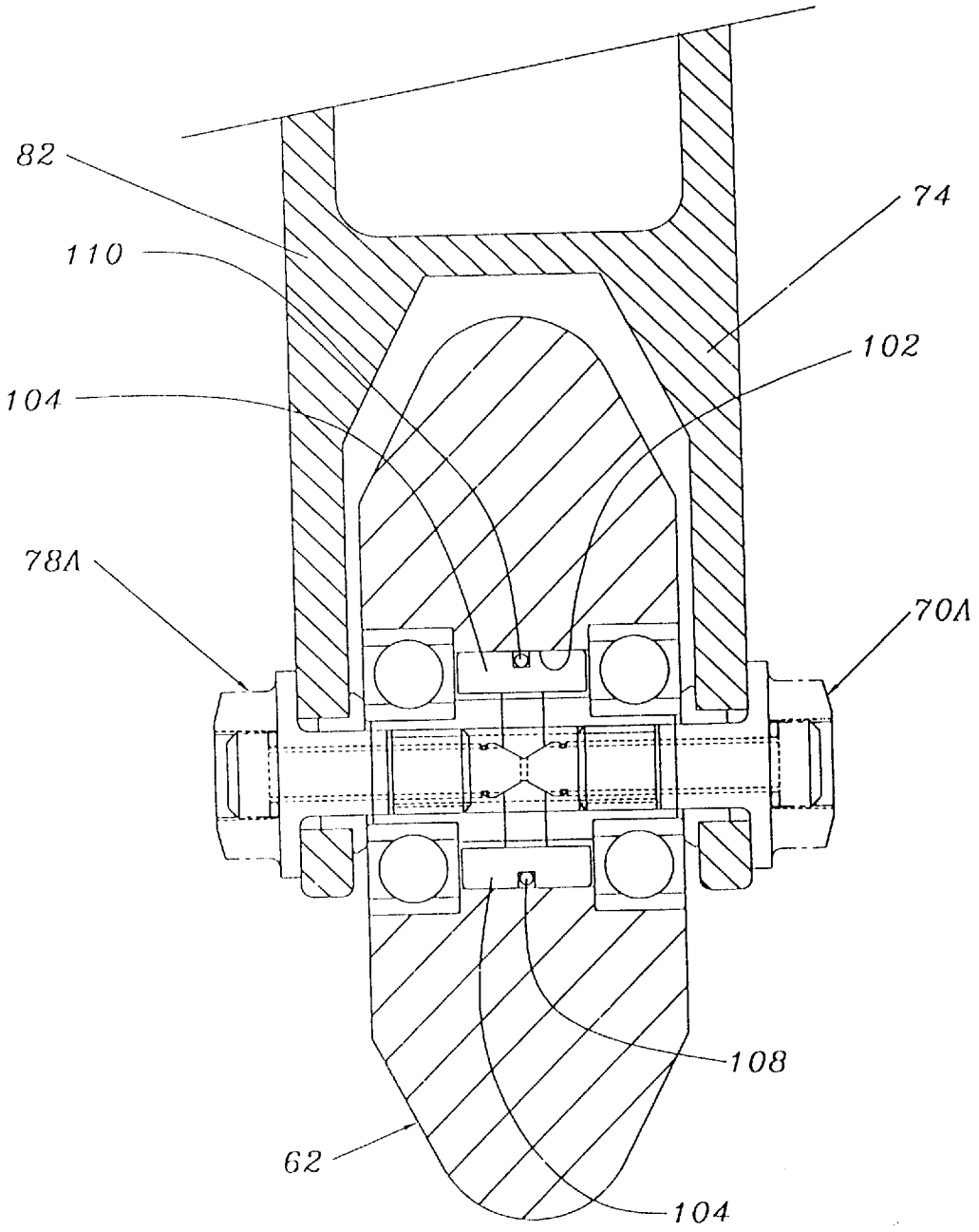
FIG. 30 is similar to FIG. 29, but shows components in engaged positions.

In operation of the embodiment shown in FIG. 29, a wrench (not shown) is introduced into the recess 148 of one of the actuator members 122A, which is threadedly rotated in the bolt 70A or 78A, to move the actuator member 122A along the axis thereof further into the cavity 64 (FIG. 29), causing one of the support beam free end surfaces 112A to ride up on the conical surface 140 of the actuator member 122A, to move the pad means 104 radially outwardly into engagement with the wheel internal surface 102 (FIG. 30) to lock the wheel 62 in place. The degree of turning of the actuator members 122A is dictated by the pitch of the actuator members.

Similar movement of the second threaded actuator member 122A may be undertaken, though it is contemplated that movement of a single actuator member 122A will suffice. The presence of the two actuating members 122A provides an election to the operator as to which side of the skate is more convenient for a locking operation. It will be apparent that this embodiment could well suffice with only one threaded actuator member 122A. It will be further apparent that a latch member similar to latch member 136, described above, easily can be adapted to the embodiment of FIG. 29.

Figure 40:
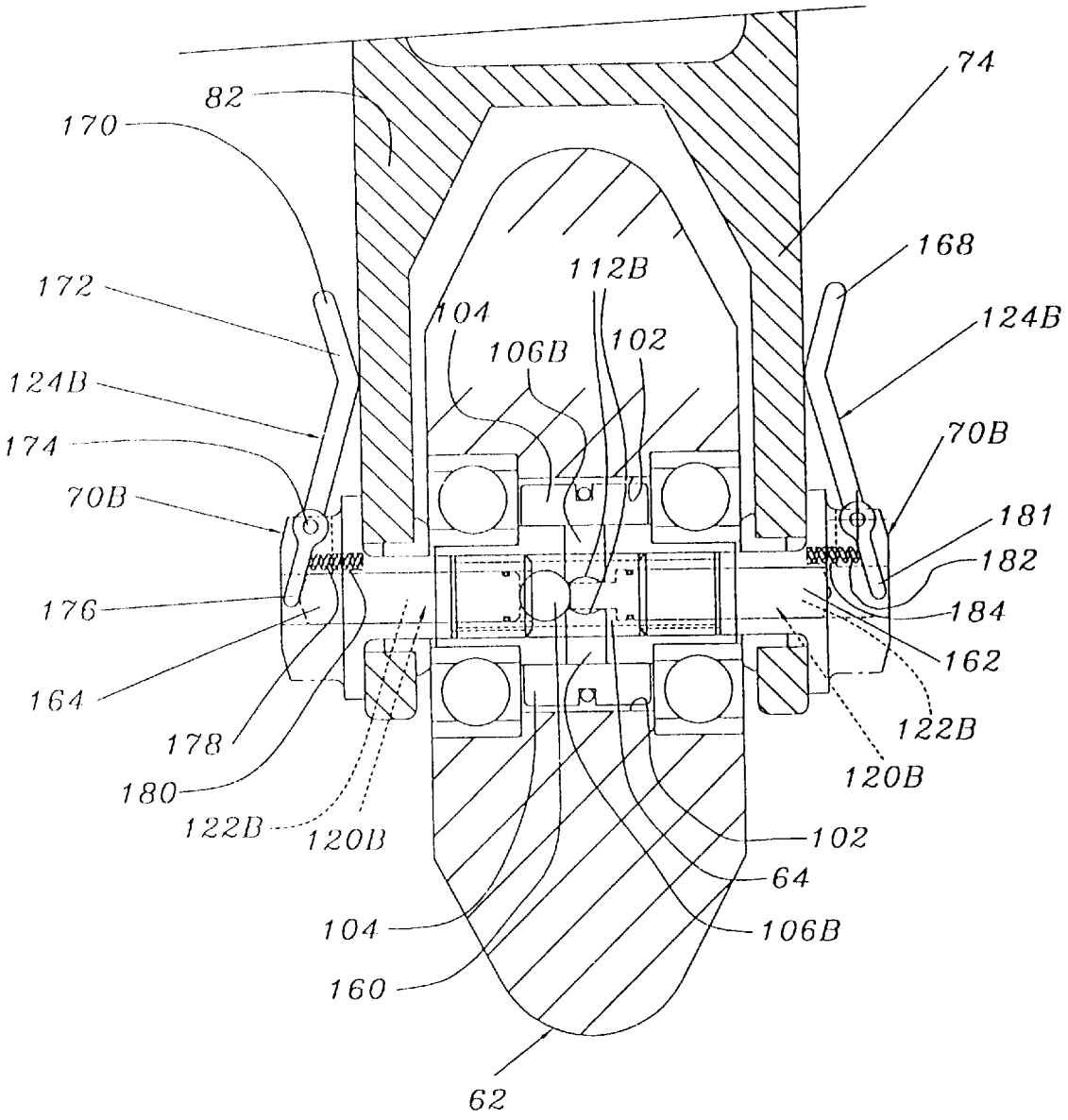
FIG. 40 is a partly sectional, partly elevational, front view of another form of anti-rotation wheel lock assembly in a disengaged position, and illustrative of another alternative embodiment of the invention.
Figure 42:
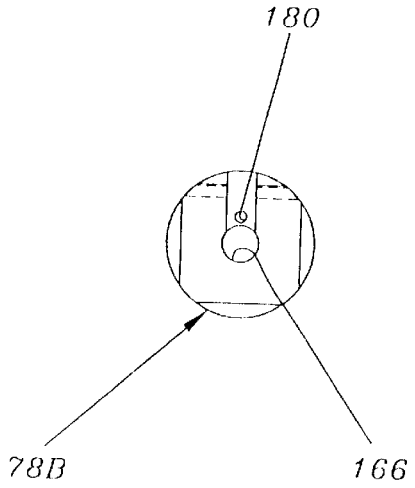
FIG. 42 is a side elevational view of a bolt component of the lock assembly of FIG. 40.
Figure 43:
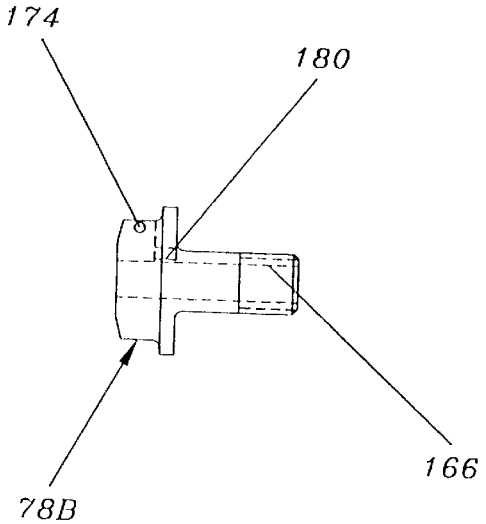
FIG. 43 is a front elevational view of the bolt component of FIG. 42.
Figure 44:
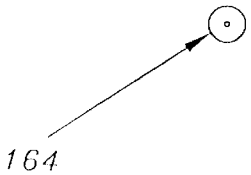
FIG. 44 is a side view of a pusher member of the brake assembly of FIG. 40.
Figure 45:
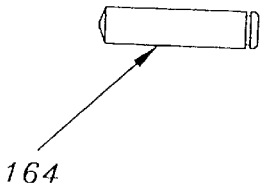
FIG. 45 is a front elevational view of the pusher member of FIG. 44.
Figure 47:
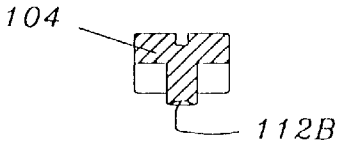
FIG. 47 is a sectional view of the lock pad assembly of FIG. 46, taken along line IV—IV.
Figure 46:
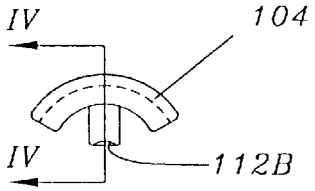
FIG. 46 is a side elevational view of the lock pad assembly of FIG. 40.
Figure 48:
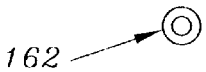
FIG. 48 is a side elevational view of another pusher member of the lock assembly of FIG. 40.
Figure 49:
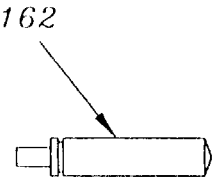
FIG. 49 is a front elevational view of the pusher member of FIG. 48.
Figure 50:
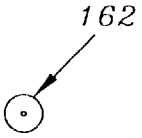
FIG. 50 is a side elevational view opposite from that shown in FIG. 48.
Figure 51:
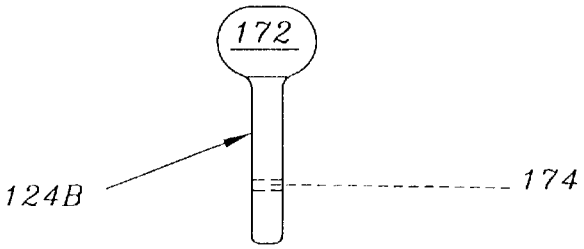
FIG. 51 is a side elevational view of a control member portion of the lock assembly shown in FIG. 40.
Figure 52:
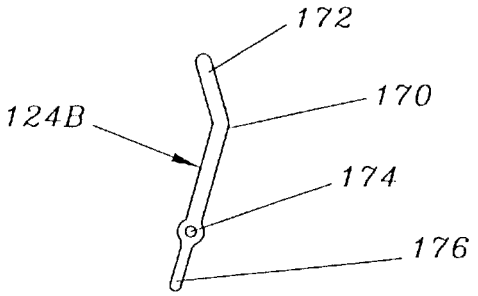
FIG. 52 is a front elevational view of the control member of FIG. 51.

Referring to FIG. 40, it will be seen that in another alternative embodiment the actuator member 122B comprises a ball 160 disposed in the cavity 64. In this embodiment, the actuator assembly 120B includes a first pusher member 162 (FIGS. 40, 48–50) extending through the first bolt 70B and engaged with the ball 160 in the cavity 64 (FIG. 40), and a second pusher member 164 (FIGS. 40, 44 and 45) extending through the second bolt 78B and engaged with the ball 160 in the cavity 64 in a manner opposed to the first pusher member 162. The bolts 70B, 78B are identical, the bolt 78B being shown in FIGS. 42 and 43. The bolts 70B, 78B are each provided with a central bore 166 in which the pusher members 162, 164 are slidable along their axes.

In the embodiment shown in FIG. 40, the free ends 112B of the support beam means 106B are of a concave configuration, complementary to the shape of the ball 160. The control member 124B comprises means for pushing a selected one of the two pusher members 162, 164 while passively permitting movement of the other of the pusher members to move the ball 160 selectively into and out of engagement with the free ends 112B of the support means 106B, to selectively move the brake pad means 104 into and out of engagement with the skate wheel internal surface 102. Such control means 124B comprises first and second spring-biased levers 168, 170, each lever spring-biased to a position for permitting movement of the pusher members 162, 164 (FIG. 40) in directions providing space in the cavity 64 alongside the post means 106B, such that the support means 106B are free to extend into the cavity 64 with the brake pad means 104 spaced from the skate internal wall 102. The spring biasing of the levers 168, 170 further serves to bias the levers against the frame portions 74, 82, respectively, so that the levers are securely retained in out-of-the-way locations adjacent the frame.

To move the brake pad means 104 from the non-engaged position shown in FIG. 40 to a locking position, the operator pulls outwardly on an upper leg 172 of one of the levers, as for example the left lever 170 in FIG. 40, to pivot the lever 170 about pivot pin 174 on bolt 78B, to move lower leg 176 against the bias of coil spring 178 disposed in a bore 180. The lower leg 176 acts against the second pusher member 164 to move the pusher member 164 further into the cavity 64. The first pusher member 162 is not engaged by the right lever 168 and is therefore free to move rightwardly in the cavity 64, as viewed in FIG. 40. The ball 160 is thus forced between the support free ends 112B, to move the pads 104 into engagement with the skate internal surface 102. As the ball 160 enters the area between the support ends 112B (FIG. 41), the first pusher member 162 engages a lower leg 181 of the lever 168, which cannot move further outwardly and blocks further movement of the ball, preventing the ball from over-shooting the position between the support ends 112B. The wheel 62 is then locked in place.

Figure 41:
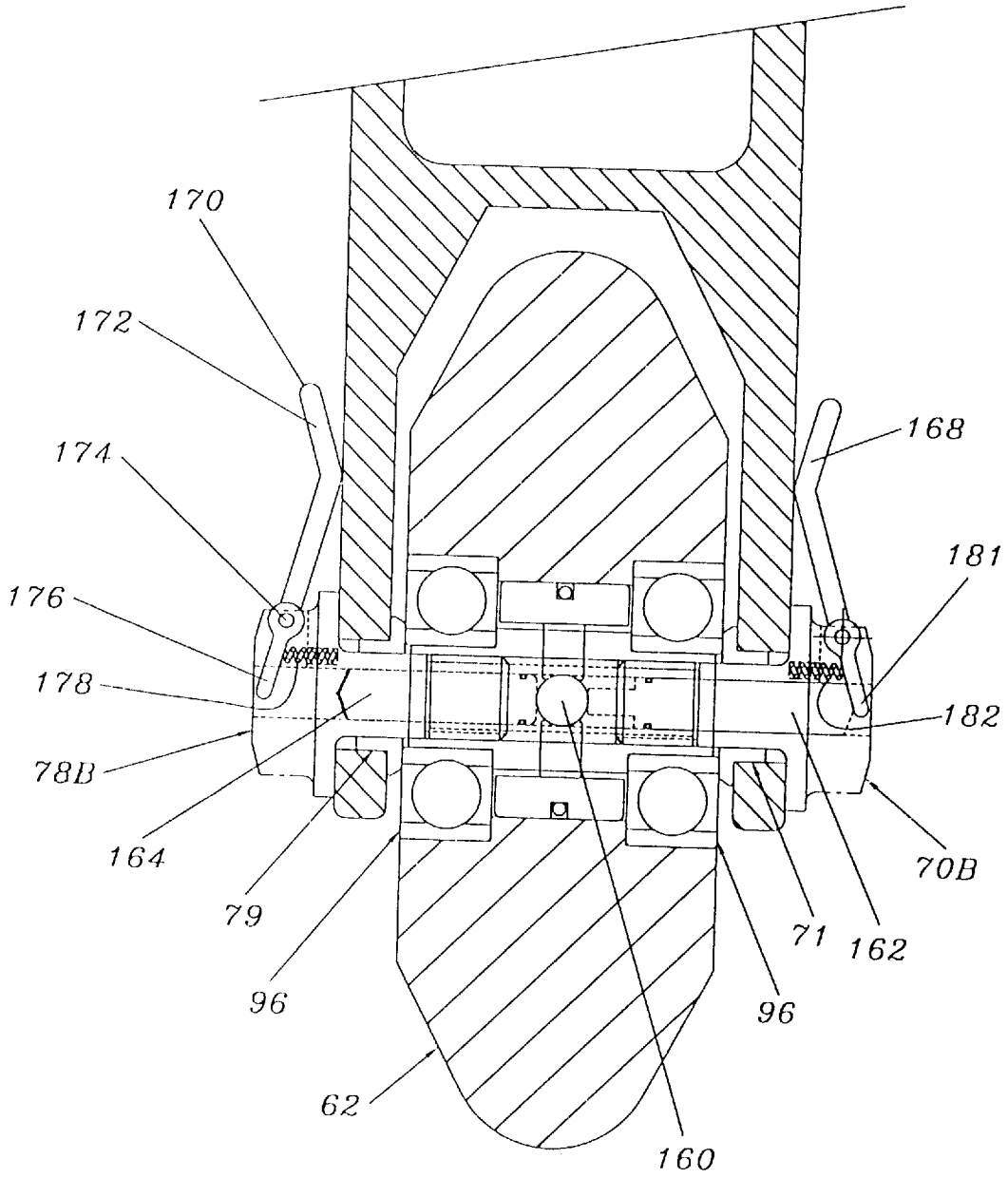
FIG. 41 is similar to FIG. 40, but shows components in engaged positions.

To release the wheel 62 for turning movement, the lever 168 is manipulated against the bias of a spring 182 disposed in a bore 184 to push the first pusher member 162 leftwardly, as viewed in FIG. 41, while the second pusher member 164 offers no resistance, enabling the first pusher member 162 to dislodge the ball 160 from between the support ends 112B, to return the assembly to the condition shown in FIG. 40.

Figure 53:
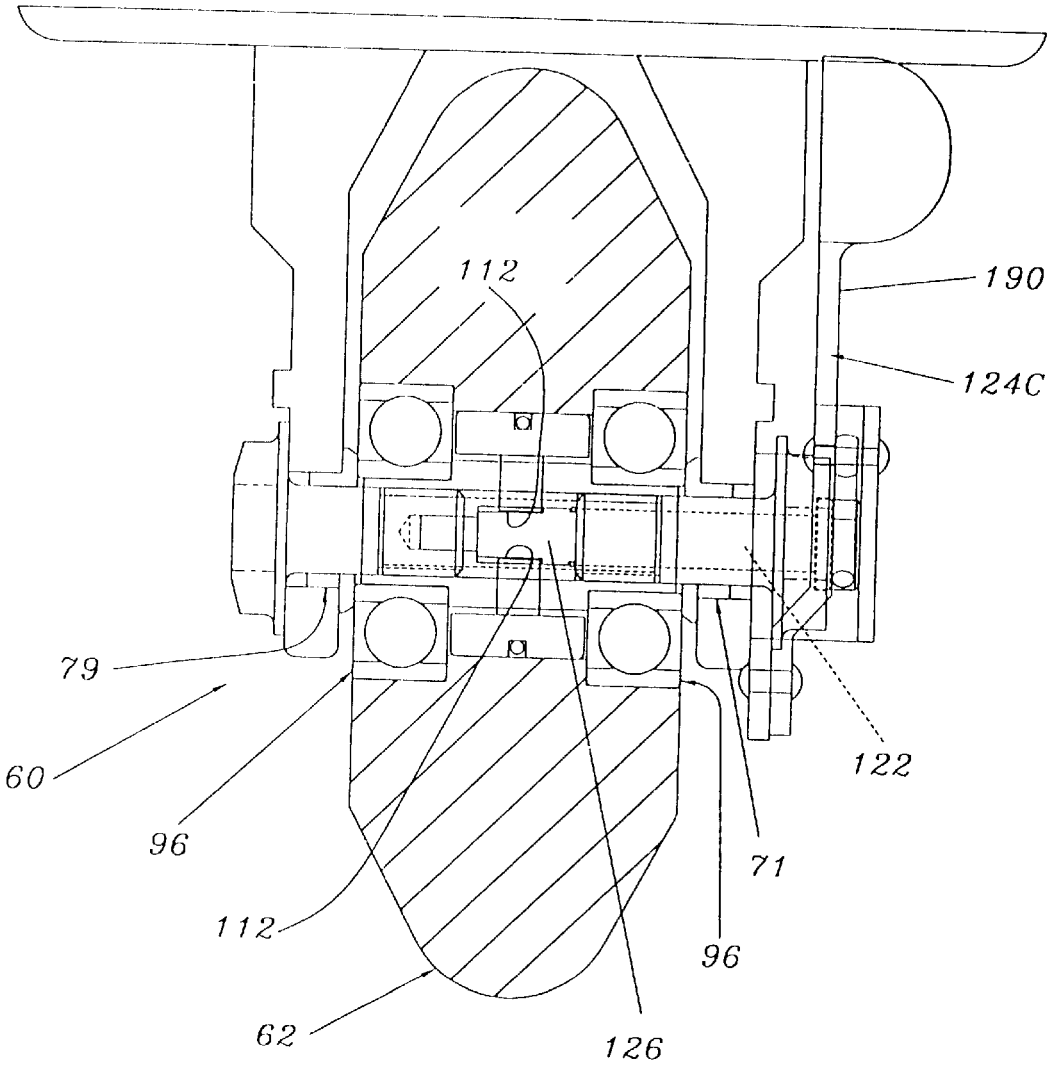
FIG. 53 is similar to FIG. 8, but illustrative of an alternative control member.
Figure 54:
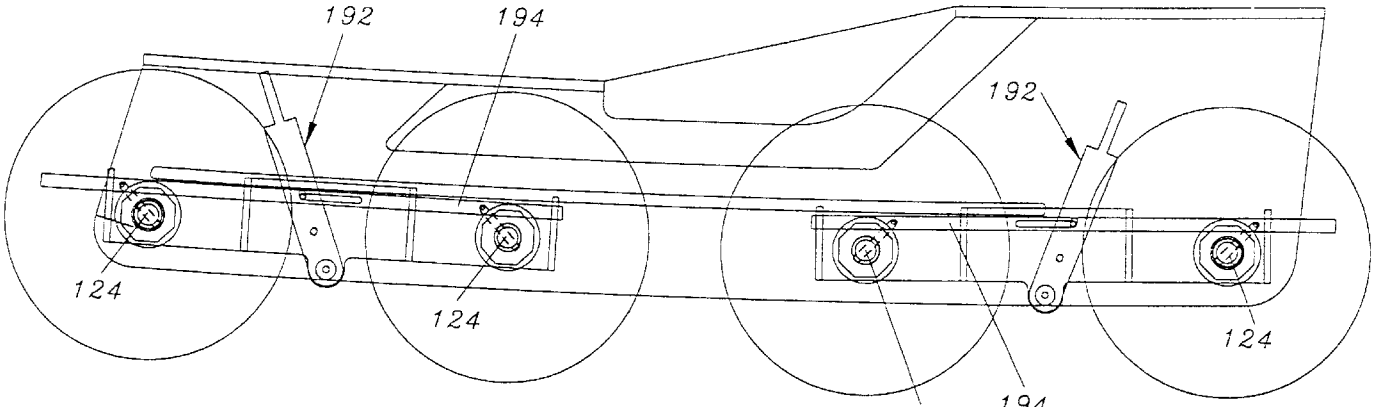
FIG. 54 is a side elevational view of a skate portion having pairs of lock assemblies of the sort shown in FIG. 53, each pair actuated by a single master control member.
Figure 55:
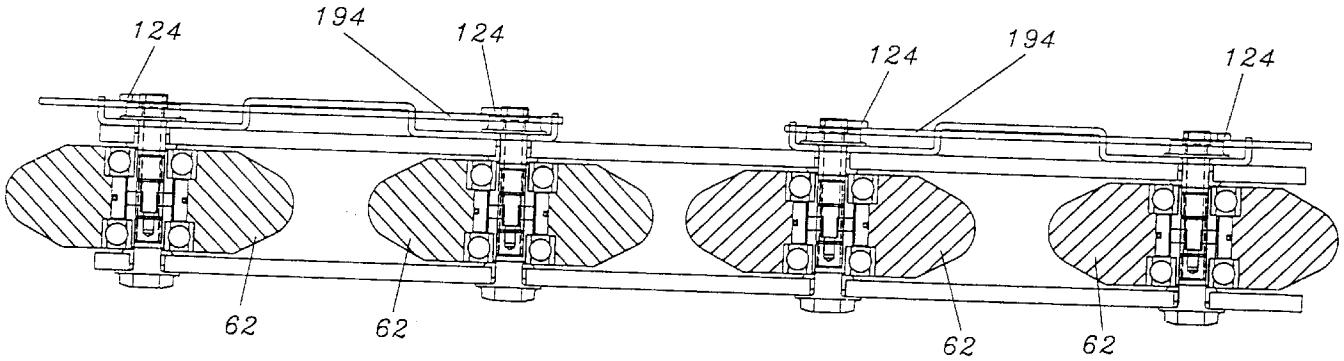
FIG. 55 is a bottom view, partly sectional and partly planar, of the skate portion of FIG. 54.
Figure 56:
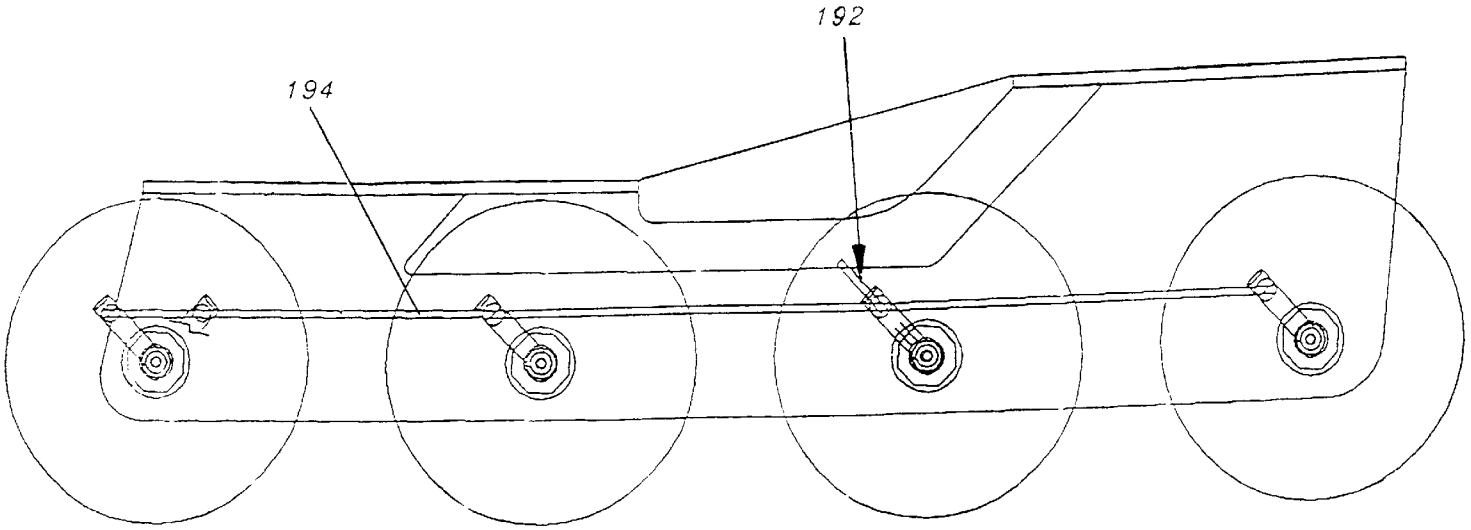
FIG. 56 is a side elevational view of a skate portion having all wheel lock assemblies actuated by a single master control member.
Figure 57:
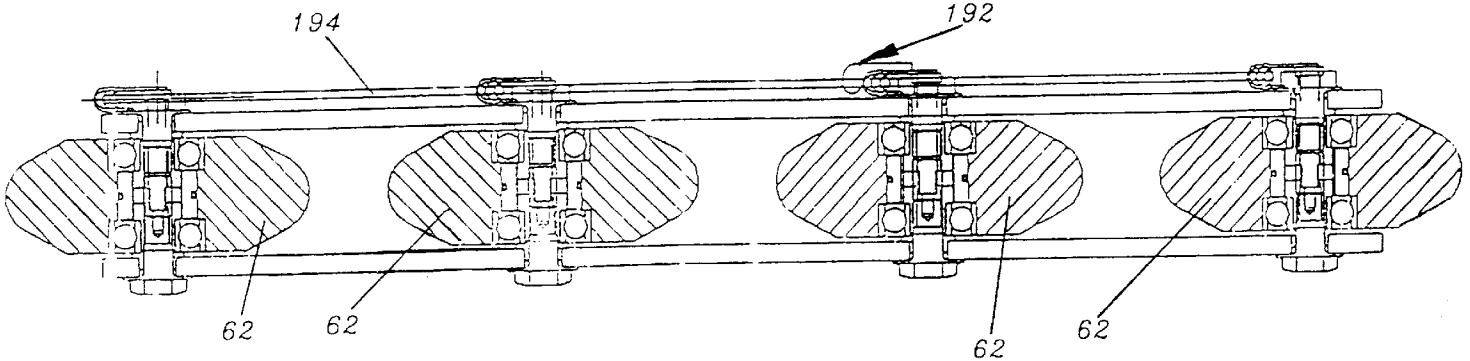
FIG. 57 is a bottom view, partly sectional and partly planar, of the skate portion of FIG. 56.
Figure 58:
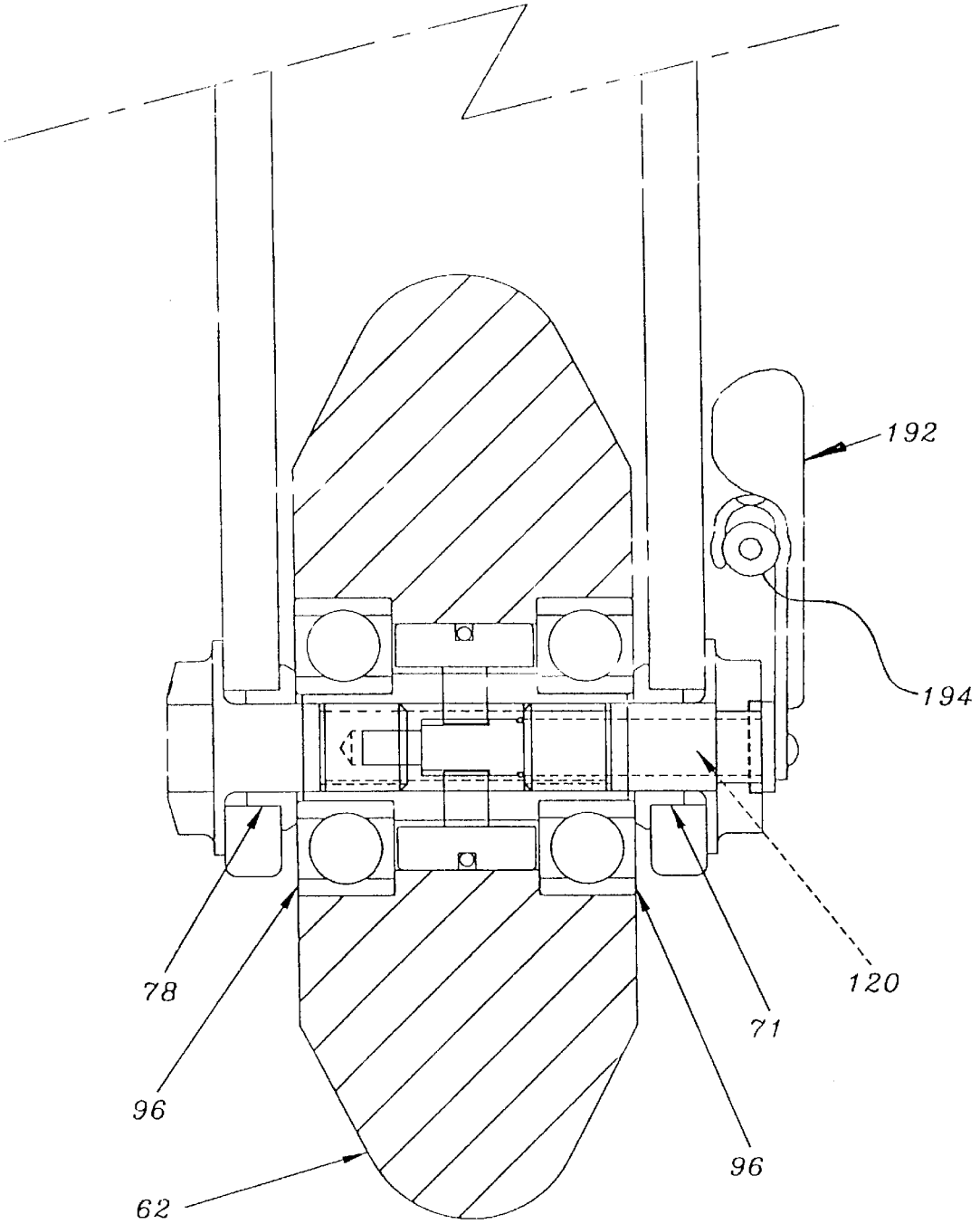
FIG. 58 is a front view, partly sectional and partly elevational, of a wheel of the skate portion of FIGS. 56 and 57, and the master control member associated therewith.
Figure 59:
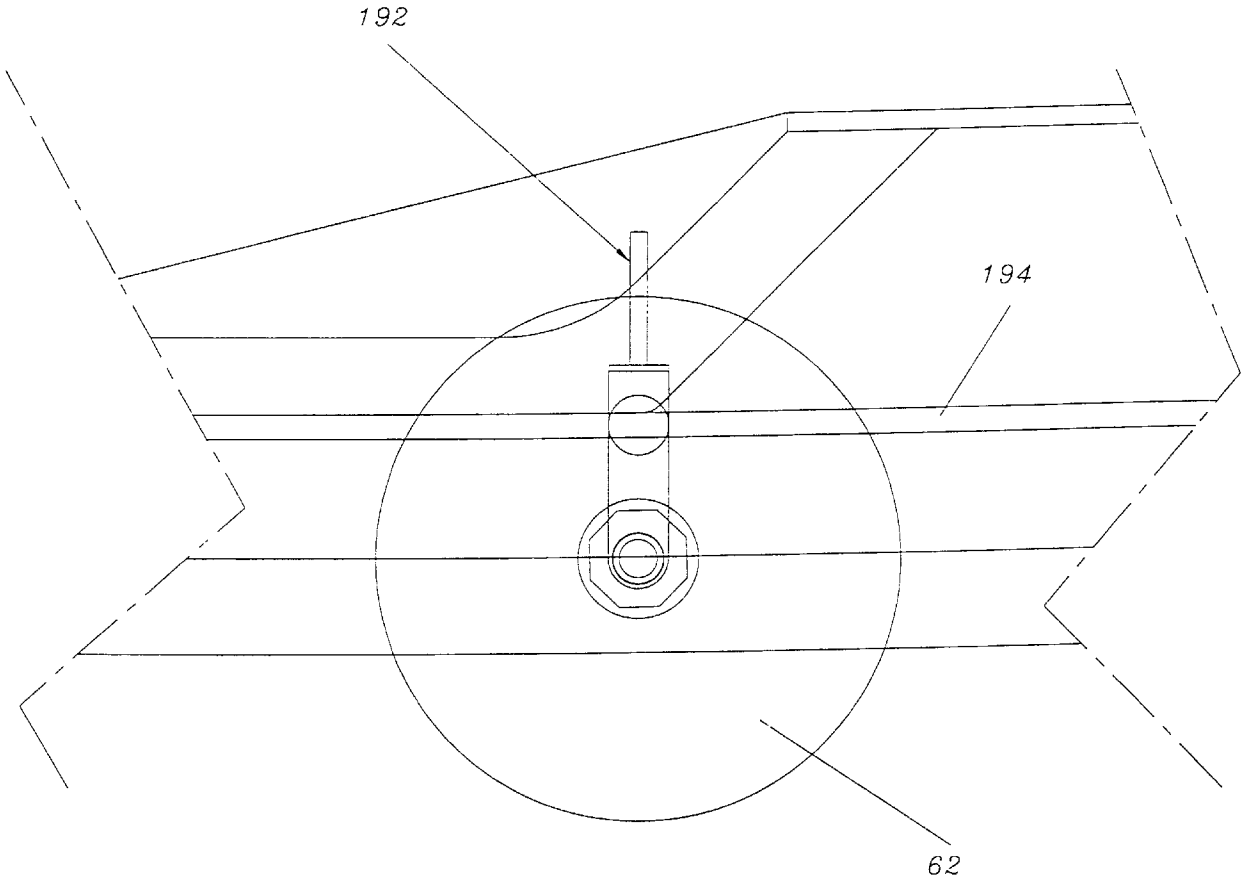
FIG. 59 is a side elevational view of the wheel of FIG. 58.
Figure 61:
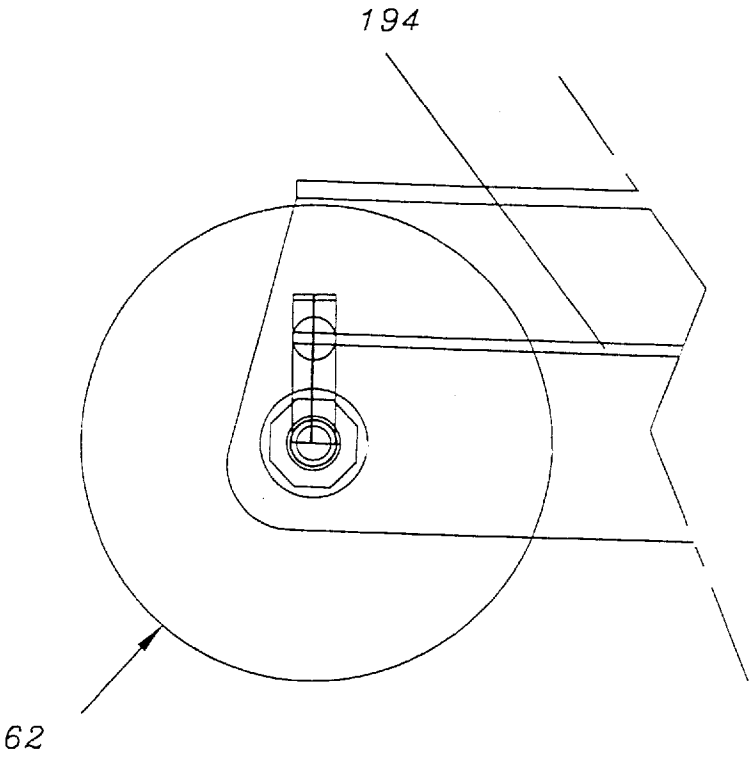
FIG. 61 is a side elevational view of the wheel assembly of FIG. 60.
Figure 60:
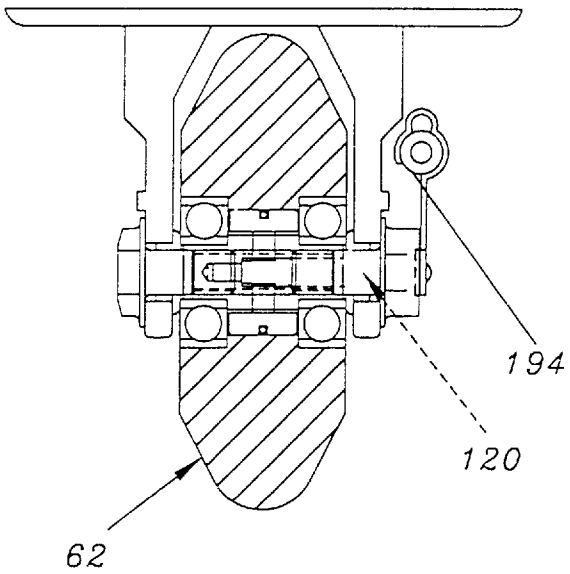
FIG. 60 is a front view, partly in elevation and partly in section of a wheel from the assembly of FIG. 56.

In FIG. 53, there is shown an embodiment similar to that shown in FIG. 8, but featuring a control member 124C comprising a locking lever 190 fixed to one of the actuator members 122 and substantially normal to the axle assembly 60, such that movement of the locking lever 190 through a quarter turn causes rotative movement of the actuator body portion 126 through a quarter turn, such that a selected one of the actuator body first and second widths 128, 130 is deployed between the support ends 112.

In FIGS. 54–61 there is illustrated an assembly in which a master control member 192 is connected to a link bar or rod 194 which, in turn, is connected to two or more of the control members 124. Thus, by actuation of a single master control member 192, two or more wheels 62 may be locked. It will be apparent that, if desired, all four wheels 62 can be controlled by a single master control member, as is illustrated in FIGS. 56–61.

It should also be appreciated that while in the foregoing description and drawings the novel wheel lock assembly has been discussed in the context of "in-line" skates, the invention may also be practiced with "non-in-line" skates, e.g., it could be used with skates having wheels arranged in a side-by-side configuration. It is also anticipated that the present invention might also be used with other wheeled apparatus, e.g., skateboards.

Still other changes may be made to the embodiments disclosed above without departing from the scope of the invention. The assembly described herein as a "lock assembly" may also be referred to in the art as a "brake assembly", or a "locking brake assembly".

What is claimed is:

1. An in-line skate having a plurality of wheels in tandem, each of said wheels having a central opening therethrough and being disposed between first and second side frame members, each of said wheels being rotatably mounted on a stationary axle assembly disposed in said wheel opening and comprising bolt means disposed in opposed openings in said side frame members, and a hollow axle member mounted on said bolt means, said skate further comprising ball bearings mounted on said axle member and said wheel mounted on said ball bearings, an inside surface of said wheel and said axle member defining a cavity therebetween, said skate characterized by pad means disposed in said cavity, support means extending from said pad means, each of said support means extending through a hole in said axle, with a free end of said support means disposed in said axle, said actuator means disposed in said axle and engaged with said free ends of said support means, said actuator means being movable in said axle and configured to cause movement of said support means, and thereby movement of said pad means, into and out of engagement with said wheel inside surface to lock and unlock said wheel respectively.

2. A lock assembly for an in-line skate, said assembly comprising:

an axle assembly for supporting a skate wheel and defining an enclosed cavity;

an actuator assembly comprising an actuator member disposed in said cavity and movable by a control means disposed externally of said axle assembly; and a lock pad assembly comprising lock pad means adapted to engage an inside surface of said skate wheel and mounted on said axle assembly, support means extending from said pad means inwardly through a portion of said axle assembly and into said cavity, and spring means urging said lock pad means and said support means inwardly to bias free ends of said support means against said actuator member;

whereby manipulation of said control means causes movement of said actuator member in said cavity to cause radial movement of said support means to cause movement of said lock pad means selectively into and out of engagement with said skate wheel inside surface.

3. The lock assembly in accordance with claim 2 wherein said axle assembly comprises an axle threaded internally, a first bolt for extending through a first opening in a first frame portion and for threaded engagement with said axle, and a second bolt for extending through a second opening in a second frame portion and for threaded engagement with said axle, with the ends of said bolts being spaced from each other and comprising walls of said cavity, and said axle defining further wall portions of said cavity.

4. The lock assembly in accordance with claim 3 wherein said axle is provided with holes therein through which extend said support means.

5. The lock assembly in accordance with claim 3 wherein said axle is provided with annular shoulders for supporting bearings.

6. The lock assembly in accordance with claim 2 wherein said actuator member extends through said axle assembly centrally and axially thereof.

7. The lock assembly in accordance with claim 6 wherein said actuator member includes an actuator body portion disposed in said cavity, said support means free ends being biased against said actuator body portion.

8. The lock assembly in accordance with claim 7 wherein said actuator member is rotatably disposed in said axle assembly, and said actuator body portion in transverse cross section has a larger first width and a smaller second width, said first width being substantially perpendicular to said second width, whereby upon rotation of said actuator member such that said first width is deployed adjacent said support means free ends, said actuator body portion urges said support means, and thereby said pad means, radially outwardly, such that said pad means engage said skate wheel inside surface.

9. The lock assembly in accordance with claim 8 wherein said control means comprises a latch member pivotally connected to said actuator member and movable between an actuating position wherein said latch member extends axially of said actuator member and said axle assembly, and a second position wherein said latch member is disposed generally perpendicular to said actuator member and said axle assembly.

10. The lock assembly in accordance with claim 3 wherein said actuator member extends through said first bolt, through said cavity, and into said second bolt.

11. The lock assembly in accordance with claim 10 wherein said actuator member includes an actuator body portion disposed in said cavity, said support means free ends being biased against said actuator body portion.

12. The lock assembly in accordance with claim 11 wherein said actuator member is rotatably disposed in said first bolt, said cavity, and said second bolt, and said actuator body portion, in transverse cross section, has a larger first width and a smaller second width, said first width being substantially perpendicular to said second width, whereby upon rotation of said actuator member such that said first width is deployed adjacent said support ends, said actuator body portion urges said support means, and thereby said pad means, radially outwardly, such that said pad means engage said skate wheel inside surface.

13. The lock assembly in accordance with claim 7 wherein said actuator member comprises a first actuator member having a first actuator body portion disposed in said cavity, said support means free ends being biased against said first actuator body portion, said first actuator body portion being generally frusto-conical in configuration and said support means free ends each having a surface complementary to said frusto-conically configured first actuator body portion, said first actuator member being movable along axis thereof in said axle assembly, such that upon said axial movement of said first actuator member inwardly of said axle assembly, said first actuator body portion urges said support means radially outwardly, thereby urging said pad means radially outwardly to engage said skate wheel inside surface.

14. The lock assembly in accordance with claim 13 wherein said actuator assembly includes a second actuator member having a second actuator body portion disposed in said cavity and opposed to said first actuator body portion, said second actuator body portion being generally frusto-conical in configuration and said support means free ends each having a surface complementary to said frusto-conically configured second actuator body portion, said second actuator member being movable along an axis thereof in said axle assembly, such that upon said axial movement of said second actuator member inwardly of said axle assembly, said second actuator body portion urges said support means radially outwardly, thereby urging said pad means outwardly to engage said skate wheel inside surface.

15. The lock assembly in accordance with claim 13 wherein said axle assembly comprises an axle threaded internally, a first bolt for extending through a first opening in a first side frame portion and for threaded engagement with said axle, and a second bolt for extending through a second opening in a second side frame portion and for threaded engagement with said axle, ends of said bolts being spaced from each other and comprising walls of said cavity, said axle defining further wall portions of said cavity, said first actuator member extending through said first bolt and into said cavity.

16. The lock assembly in accordance with claim 14 wherein said axle assembly comprises an axle threaded internally, a first bolt for extending through a first opening in a first frame portion and for threaded engagement with said axle, and a second bolt for extending through a second opening in a second frame portion and for threaded engagement with said axle, ends of said bolts being spaced from each other and comprising walls of said cavity, said axle defining further wall portions of said cavity, said first actuator member extending through said first bolt and into said cavity, and said second actuator member extending through said second bolt and into said cavity.

17. The lock assembly in accordance with claim 15 wherein said first actuator member is threaded and said first bolt is internally threaded to threadedly receive said first actuator member, said first actuator member having a head portion comprising said control means by which said first actuator member can be rotated to cause said radially outward movement of said pad means.

18. The lock assembly in accordance with claim 16 wherein said first and second actuator members are threaded, said first bolt is internally threaded to threadedly receive said first actuator member, and said second bolt is internally threaded to threadedly receive said second actuator member, each of said actuator members having a head portion comprising said control means by which said actuator members can be rotated.

19. The lock assembly in accordance with claim 3 wherein said actuator assembly comprises said actuator member which comprises a ball disposed in said cavity, said actuator assembly further comprises a first pusher member extending through said first bolt and engaged with said ball in said cavity, and a second pusher member extending through said second bolt and engaged with said ball in said cavity in a manner opposed to said first pusher member, said free ends of said support means being concave in configuration and complementary to said ball, and said control means comprises means for pushing a selected one of said first and second pusher members and passively permitting movement of the other of said first and second pusher members to move said ball selectively into and out of engagement with said free ends of said support means, to selectively move said lock pad means into and out of said engagement with said skate wheel internal surface.

20. The lock assembly in accordance with claim 19 wherein said means for pushing a selected one of said first and second pusher members comprises first and second spring-biased levers, with said levers being spring biased to a position for said passively permitting of movement of said pusher members, but movable against said spring bias for said pushing of a selected one of said pusher members to move said ball into engagement with said support means free ends, each of said levers being associated with one of said pusher members.

21. The lock assembly in accordance with claim 20 wherein said levers are spring biased into a position alongside said frame portions, respectively.

22. The lock assembly in accordance with claim 8 wherein said control means comprises a locking lever fixed to said actuator member, said locking lever being substantially perpendicular to said axle assembly, whereby movement of said locking lever through a quarter turn causes rotative movement of said actuator body portion such that a selected one of said first and second widths is deployed adjacent said support ends.

23. A lock assembly for an in-line skate, said assembly comprising for a selected plurality of wheels of said skate:

an axle assembly for each of said wheels for supporting said wheel, said axle assembly defining an enclosed cavity in said axle assembly;

an actuator assembly for each of said wheels, said actuator assembly comprising an actuator member disposed in said cavity and movable by a control member disposed externally of said axle assembly;

a lock pad assembly for each of said wheels, said lock pad assembly comprising brake pad means adapted to engage an inside surface of said skate wheel, support means interconnecting said lock pad means and said actuator member, and spring means urging said lock pad means and said support means toward said actuator member to bias free ends of said support means against said actuator member;

a link member interconnecting said control members; and a master control member connected to said link member for moving said link member and thereby said control members and said actuator members in their respective cavities to cause radial movement of said support means to cause radial movement of said lock pad means in each of said selected plurality of wheels to cause movement of said lock pad means selectively into and out of engagement with said skate wheel inside surface.

24. A lock assembly for a wheel of a skate, said lock assembly comprising:

an axle;

a pair of lock pads for engaging an internal surface of said wheel and preventing rotation of said wheel, said lock pads being in part disposed within said axle cavity;

an actuator disposed centrally and axially in and movable rotatably in said cavity and engaged with said lock pads such that rotative movement of said actuator causes movement of said lock pads to engage and disengage from said wheel; and a control means disposed outside said wheel and connected to said actuator said control means being manipulable to cause selectively said engagement and disengagement of said lock pads relative to said wheel.

25. A lock assembly according to claim 24 wherein said lock pad assembly comprises a knurled surface for engaging said internal surface of said wheel.

26. A lock assembly according to claim 24 wherein said lock pad assembly comprises a high friction surface for engaging said internal surface of said wheel.

* * * * *